US011123793B2

(12) United States Patent
Bilski et al.

(10) Patent No.: US 11,123,793 B2
(45) Date of Patent: Sep. 21, 2021

(54) COOLANT NOZZLE FOR COOLING A METAL STRAND IN A CONTINUOUS CASTING INSTALLATION

(71) Applicant: Primetals Technologies Austria GmbH, Linz (AT)

(72) Inventors: Lukasz Bilski, Leonding (AT); Markus Eckert, Engerwitzdorf (AT); Thomas Fuernhammer, Haidershofen (AT); Reinhard Simon, Linz (AT); Thomas Stepanek, Vienna (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 0 days.

(21) Appl. No.: 16/618,620

(22) PCT Filed: May 23, 2018

(86) PCT No.: PCT/EP2018/063459
§ 371 (c)(1),
(2) Date: Dec. 2, 2019

(87) PCT Pub. No.: WO2018/224304
PCT Pub. Date: Dec. 13, 2018

(65) Prior Publication Data

US 2020/0180017 A1 Jun. 11, 2020

(30) Foreign Application Priority Data

Jun. 7, 2017 (AT) ..... A 50475/2017

(51) Int. Cl.
*B22D 11/124* (2006.01)
*B05B 7/04* (2006.01)
*B22D 11/22* (2006.01)

(52) U.S. Cl.
CPC ..... *B22D 11/1246* (2013.01); *B05B 7/0433* (2013.01); *B22D 11/225* (2013.01)

(58) Field of Classification Search
CPC ... B22D 11/1246; B22D 11/22; B22D 11/225; B22D 11/112; B05B 7/1263; B05B 7/0433
See application file for complete search history.

(56) References Cited

U.S. PATENT DOCUMENTS 3,096,023 A 7/1963 Thomas
4,019,560 A * 4/1977 Gruner ..... B22D 11/1246 164/486

(Continued)

FOREIGN PATENT DOCUMENTS

AT 517772 A1 4/2017
CN 101811181 A 8/2010

(Continued)

OTHER PUBLICATIONS

English machine translation of CN 102423733 (Year: 2015).*

(Continued)

*Primary Examiner* — Kevin P Kerns
*Assistant Examiner* — Steven S Ha
(74) *Attorney, Agent, or Firm* — Ostrolenk Faber LLP

(57) ABSTRACT

A coolant nozzle (1) for cooling a metal strand in a continuous casting installation has a mouthpiece (5), which is arranged at a nozzle outlet end (4) and through which liquid coolant (6) can emerge from the coolant nozzle (1). To allow a rapid buildup of pressure at the coolant nozzle (1), it provides a feed (8), which is formed as a tube-in-tube system (9) arranged upstream of the mouthpiece (5) in the direction of through-flow (7) and has a feed outlet end (10), through the first tube (11) in which control air (13) can be brought up to the feed outlet end (10) and through the second tube (12)

(Continued)

of which the liquid coolant (6) can be fed to the mouthpiece (5) by way of the feed outlet end (10), and also provides a control valve (14), which is integrated in the feed (8), is arranged at the feed outlet end (10), can be actuated pneumatically by using the control air (13) and is intended for controlling the feed of the liquid coolant (6) into the mouthpiece (5).

17 Claims, 4 Drawing Sheets

(56) References Cited

U.S. PATENT DOCUMENTS

| | | | | |
|---|---|---|---|---|
| 8,820,663 | B2 | 9/2014 | Vidusek et al. | |
| 9,555,950 | B2 | 1/2017 | Le Maner | |
| 2004/0098989 | A1 * | 5/2004 | Mansour | B05B 7/0458 60/775 |

FOREIGN PATENT DOCUMENTS

| | | | | |
|---|---|---|---|---|
| CN | 201807472 | U | 4/2011 | |
| CN | 102170983 | A | 8/2011 | |
| CN | 103464708 | A | 12/2013 | |
| CN | 102423733 | B | 3/2015 | |
| CN | 105050644 | A | 11/2015 | |
| DE | 1 400 690 | A1 | 10/1968 | |
| EP | 1 356 868 | A1 | 10/2003 | |
| EP | 2 412 459 | A1 | 2/2012 | |
| EP | 2 527 061 | A1 | 11/2012 | |
| EP | 2 548 652 | A1 | 1/2013 | |
| WO | WO-9952642 | A1 * | 10/1999 | B05B 7/0483 |
| WO | WO 2013/019952 | A1 | 2/2013 | |

OTHER PUBLICATIONS

International Search Report dated Jul. 24, 2018 in corresponding PCT International Application No. PCT/EP2018/063459.

Written Opinion dated Jul. 24, 2018 in corresponding PCT International Application No. PCT/EP2018/063459.

Search Report dated Apr. 17, 2018 in corresponding Austrian Patent Application No. A50475/2017.

Chinese Office Action, dated Feb. 3, 2021, issued in corresponding Chinese Patent Application No. 201880037939.1. English Translation. Total 22 pages.

* cited by examiner

COOLANT NOZZLE FOR COOLING A METAL STRAND IN A CONTINUOUS CASTING INSTALLATION

CROSS-REFERENCE TO RELATED APPLICATIONS

The present application is a 35 U.S.C. §§ 371 national phase conversion of PCT/EP2018/063459, filed May 23, 2018, the contents of which are incorporated herein by reference, which claims priority of Austrian Patent Application No. A50475/2017, filed Jun. 7, 2017, the contents of which are incorporated by reference herein. The PCT International Application was published in the German language.

The invention relates to a coolant nozzle for cooling a metallic strand in a continuous casting plant.

A continuous casting plant, for example a plant for casting steel slabs, has a running direction of a strand through the continuous casting plant. The plant comprises inter alia a ladle having an outlet pipe, a casting distributor which is disposed below the ladle and a casting tube, and a plug or another closure, respectively, that is disposed in the casting distributor. A permanent mold disposed below the casting distributor receives a lower end of the casting tube and the mold has cooled broadside plates and cooled narrow-side plates.

Liquid steel is directed by the outlet tube into the casting distributor which is situated in the ladle. The liquid steel from the casting distributor is in turn directed by way of the casting tube into a permanent mold, wherein a mass flow of the steel flowing into the permanent mold is controlled with the aid of the plug or of another closure.

The steel on the contact faces of the (cooled) broadside plates and to the (cooled) narrow-side plates of the permanent mold (primarily) cools in the permanent mold and there solidifies such that the steel, in the form of a strand having a rectangular cross section, exits the permanent mold. When the strand exits, it has a solidified shell, typically of several centimeters in thickness, while a majority of the cross section of the strand is still liquid.

By means of a strand guiding system, the strand below the permanent mold is guided in a horizontal line through a so-called casting bow disposed below the permanent mold, or downstream thereof, respectively. Thereafter at the exit of the casting bow the strand is guided horizontally onward, or in a manner wherein the strand is supported by strand guiding system support elements, that is by rollers of the strand guiding system, and then is guided or transported away.

The strand is contemporaneously secondarily cooled (secondary cooling) by a liquid coolant (typically water, in so-called "water-only" cooling) or a mixture of a liquid cooling medium and a gas (so-called "air mist" cooling, or spraying with air/water, respectively), while using corresponding (spray) nozzles ("water-only" nozzles) "air mist" nozzles.

Downstream of the casting bow in the continuous casting plant there is a post-connected apparatus, for example, a flame cutting machine, which cuts the strand, which is for example in the form of slabs, to size or into pieces.

However, the strand can also be further processed directly by a (another) post-connected apparatus, for example a roll stand of a casting/rolling composite plant, without first being cut into pieces.

For so-called "water only" nozzles for secondary cooling, cooling intensity can be adjusted over a minor range as a function of a coolant pressure, or of a water pressure.

However, it is disadvantageous that the spray pattern is likewise varied as a function of the water pressure, because a uniform surface temperature of the strand is not guaranteed on account of a non-homogeneous discharge of heat.

An objective of the so-called "air mist" nozzles of the secondary cooling is to increase a spread between the maximum and minimum throughflow quantity of coolant through the spray nozzles. However, it has been demonstrated in practice that a spread higher than 10:1 for "air mist" nozzles, or 3:1 for "water only" nozzles is hard to achieve. In certain steel types, this can lead to excessive cooling of the strand edges and thus lead to quality losses.

Moreover, the energy consumption for providing compressed air to the "air mist" nozzles is very high, such that an increased emission of CO2 results, and higher costs for operating the plant result.

Such secondary cooling is known from DE 199 28 936 C2. In this secondary cooling, the strand is cooled by intermittent spraying by a coolant nozzle. It is disadvantageous that the throughflow through the coolant nozzles cannot be actively set/actuated to avoid large spreads between the maximum and the minimum coolant quantities which are delivered onto the strand by the coolant nozzles can in particular not be implemented.

Since edge regions of a steel strand have to be cooled to a substantially lesser degree than the central region of the strand to achieve a consistent surface temperature, use of this secondary cooling leads to excessive cooling, intense cooling, of the edge regions, causing the quality of the steel strand to suffer.

A coolant nozzle for cooling a metallic strand in a continuous casting plant is known from AT 517772 A1. The coolant nozzle has a mouthpiece or outlet nozzle that is disposed on a nozzle exit end, an infeed that is configured as a tube-in-tube system, so that control air is capable of being fed through the first tube of the infeed, and liquid coolant is capable of being fed through the second tube of the infeed. A switchover valve is disposed between the mouthpiece and the infeed and is pneumatically activatable while using the control air. The switchover valve herein, which is a separate non-integrated component, is screw-fitted to the infeed from the outside. The mouthpiece is screw-fitted to the switchover valve from the outside.

SUMMARY OF THE INVENTION

It is an object of the invention to overcome the disadvantages of the prior art and to disclose a device for cooling a metallic strand by a way in which the cooling intensity can be set in a large range in a simple, robust and energy-efficient manner.

This object is achieved by a coolant nozzle for cooling a metallic strand in a continuous casting plant as disclosed herein.

The coolant nozzle for cooling a metallic strand in a continuous casting plant includes a mouthpiece which is disposed on a nozzle exit end of the coolant nozzle. Liquid coolant from the coolant nozzle can exit, in particular through a mouthpiece exit opening on the mouthpiece.

Such a mouthpiece may be a specially fabricated tubular end piece of an arbitrary shape, size and other design feature. The spray pattern of the coolant nozzle, which for example is a triangle, a trapezoid, or a complete cone or a hollow cone, can be determined by the design of the mouthpiece exit opening of the mouthpiece.

The mouthpiece can expediently be a releasable element of the coolant nozzle, for example to be releasable or screw-fittable, while using a screw-fitting or a thread, so that the mouthpiece may be inserted or replaced, respectively, in a variable manner, depending on the desired use.

In particular, the mouthpiece can be screw-fitted to or onto an infeed, in particular an infeed exit end of the infeed, optionally referred to as a mouthpiece receptacle.

Further, the mouthpiece is configured with a throughflow internal cavity in the mouthpiece (between the mouthpiece entry opening and the mouthpiece exit opening) through which the liquid coolant flows. That flow mouthpiece has a minor flow volume, for example in the throughflow direction, of the liquid coolant through the mouthpiece the mouthpiece is configured to be as short as possible.

If this cavity is configured to be as small as possible, only a minor quantity of coolant can accumulate in dead space volume in a blocked coolant nozzle. The exiting of the quantity of coolant, which is not controllable by switching off is undesirable at least to a comparatively large degree. A rapid pressure buildup of the liquid coolant in the coolant nozzle is also enabled.

The coolant nozzle has an infeed which is configured as a tube-in-tube system and is disposed ahead of the mouthpiece in the throughflow direction, the mouthpiece has an infeed exit end. Control air is capable of being guided to the infeed exit end through the first tube of the infeed. The liquid coolant is capable of being fed through the second tube of the infeed to the mouthpiece by the infeed exit end.

A tube-in-tube system is an assembly of at least two tubes, one first tube and one second tube, wherein one tube of those two tubes is disposed within the other tube.

For example, the first inner tube in the tube-in-tube system is in the second outer tube surrounding the inner tube. A cavity is provided between the outer wall face of the inner tube and the inner wall face of the outer tube.

A reversed arrangement of the two tubes, with the second tube disposed within the first tube, is likewise possible.

An elongate hollow member, having a length that is typically substantially larger than its diameter, may be understood to be a tube.

The tube-in-tube system of the coolant nozzle, which are outboard hoses or tubes that for feeding the control air lie outside the coolant nozzle, are avoided. The assembly and disassembly of a coolant nozzle in a tight strand routing is substantially facilitated. Moreover, the reliability of the coolant nozzle is increased on account of the inboard feeding of the control air.

Moreover, the tube-in-tube system reinforces the mechanical strength of the coolant nozzle.

The tube, or the hollow member, respectively, of the tube-in-tube system, or of the coolant nozzle, may be an integral device or may be comprised of a plurality or of many assembled parts/elements. Likewise, the tube, or the hollow member, respectively, may have internal diameters and/or external diameters, which vary along the length of the tube.

According to one preferred refinement, the first tube and/or the second tube are/is configured in multiple parts wherein the parts are capable of being screw-fitted or welded to one another. The screw-fittable multi-part characteristic enables an extremely flexible design of the coolant nozzle. Moreover, parts of the coolant nozzle can be replaced simply, so that maintenance is simplified.

Furthermore, the tubes used in the tube-in-tube system do not necessarily have a substantially round and/or circular cross-section (for the "external cross section" ("outer cross-sectional profile") as well as for the "internal cross section" (cross-sectional shape of the "internal cavity")). Arbitrary cross-sectional shapes, such as a round or circular cross section, or an oval or rectangular cross section, and/or a cross section assembled from round and straight elements are possible in the case of the tubes mentioned here.

With this "tube-in-tube" arrangement of the at least two tubes in the case of the infeed, two flow paths, at the infeed/or through the infeed may be configured for the control air and for the liquid coolant, respectively. The first of the two flow paths run the control air through the inner tube that is, in the interior of the inner tube. The second of the two flow paths runs the liquid coolant outside the inner tube and within the outer tube, between the outer wall face of the inner tube and the inner wall face of the outer tube.

On account of the design of the tube-in-tube system at the infeed, the coolant nozzle enables the control air, for example instrument air, nitrogen, or another, preferably non-flammable, gaseous pressure medium, and the liquid coolant to be delivered up to very close behind the nozzle exit end, up to the mouthpiece.

The term instrument air is to be understood as the most varied types of gases, for example, ambient air, technically purified air, or nitrogen, which are used for actuating pneumatic valves.

In a concentric tube-in-tube system in which or at least in the "tube-in-tube" region, the inner tube is disposed in the outer tube so they are concentric which is an exemplary special design embodiment of such a tube-in-tube system and is preferred because it can be implemented in a simple manner during construction.

Furthermore, the infeed may be configured to be rectilinear or to be bent, having at least one bend. A length of the infeed may also be designed to be variable. As a result, coolant nozzles of highly dissimilar lengths and shapes can be implemented in a flexible and advantageous manner.

The coolant nozzle has a switchover valve disposed on the infeed exit end for controlling the infeed of the liquid coolant into the mouthpiece. It is pneumatically activatable while using the control air.

The coolant nozzle for controlling coolant throughflow through the nozzle comprises a switchover valve, which is a through flow control valve which can be passed by a flow of the liquid coolant and be pneumatically activated by the control air, for example instrument air.

This pneumatic switchover valve of the coolant nozzle is situated at the infeed exit end of the infeed of the coolant nozzle and thus, in the throughflow direction, ahead of the mouthpiece of the coolant nozzle.

The switchover valve is integrated in the infeed, so that elements of the switchover valve are also elements of the infeed. For example, a valve housing or a component part of the valve housing, can also be an element of the infeed, for example part of the inner or the outer tube.

"Disposed on the infeed exit end" in the switchover valve does not preclude parts of the switchover valve, or the switchover valve in its entirety, in the throughflow direction being disposed on the switchover valve directly after the infeed exit end, for example between the infeed exit end and the mouthpiece, or a mouthpiece entry or opening. It also does not preclude parts of the switchover valve or the switchover valve being disposed on the switchover valve directly after the infeed exit end and already in the region of the mouthpiece entry or opening.

Conversely, "disposed on the infeed exit end" for the switchover valve also includes that parts or all of the switchover valve in the throughflow direction are disposed on the switchover valve directly ahead of the infeed exit end, in the infeed, or in the tube-in-tube system, respectively, are integrated as part of the inner or the outer tube in the infeed, or in the tube-in-tube system, directly ahead of the infeed exit end.

The switchover valve can be intermittently opened and closed in a corresponding manner so as to be actuated and activated by the control air. The coolant throughflow, or the volumetric flow of the coolant through the nozzle may be controlled in an open-loop or closed-loop manner as a function of a desired cooling output.

When control air bears on the switchover valve, which is pneumatically activatable by the control air and is capable of being passed by a flow of the liquid coolant, the switchover valve is thus closed, and the liquid coolant cannot flow past the valve and on onward to the mouthpiece of the coolant nozzle. On the other hand, when no control air bears on the switchover valve by the switchover valve is thus open, and the liquid coolant can flow past the valve and onward to the mouthpiece of the coolant nozzle.

Bringing the control air to bear on the valve can take place while using a pilot valve which is in particular also pneumatically controllable.

Pressure of the control air that is capable of activating the switchover valve is expediently higher, for example 1.5 times higher, than the pressure of the liquid coolant that is controlled by the switchover valve.

Furthermore expediently, activation of the switchover valve such as intermittent opening and closing of the valve can be performed by a switching element of the switchover valve. The switching element is potentially being configured, for example, as a valve gate of a gate valve, or a control piston of a seat valve, so that the throughflow of the cooling medium through the switchover valve is either opened or closed based on the position of the switching element.

An opened position of the switching element is a position at which the throughflow of the cooling medium through the switchover valve is opened. A closed position of the switching element is a position at which the throughflow of the cooling medium through the switchover valve is closed.

The switching element is typically displaced in or counter to the throughflow direction of the liquid coolant through the coolant nozzle by activation of the switching element when activating the switchover valve, or when opening and closing the switchover valve by the control air. The switching element then closes/blocks the coolant flow or releases the coolant flow through the coolant nozzle.

Furthermore, the person skilled in the art will also be familiar with switchover valves in which the switching element is rotated when activated.

The switchover valve may be embodied as a gate valve or as a seat valve. A seat valve it advantageous because the cooling medium is sealed in a leakage-free manner without further valves, providing a higher degree of prevention of contamination.

For the switchover valve as a seat valve, it is advantageous for the switching element to comprise a control piston, comprised of a corrugated bellows or a diaphragm guides and optionally seals the control piston particularly in relation to the infeed, for example in relation to the inner and/or the outer tube, or in relation to the valve housing, respectively.

The diaphragm or the corrugated bellows is preferably comprised of a corrosion-free metal, preferably steel, or of a plastics material, preferably heat-resistant plastics material, for example, polyimide or polyether aryl ether ketone (PEEK), which has notable strength values up to temperatures beyond 250° C.

Corrugated bellows is preferably disposed concentrically on the first and inner tube of the tube-in-tube system, and is disposed on a second part of the inner tube that is configured as a corrugated bellows detent. Corrugated bellows is capable of being guided axially relative to the inner tube, particularly in relation to the corrugated bellows detent.

Expressed in a simplified and visualized manner, the inner tube, or the first tube, respectively, represents a type of linear guide for the corrugated bellows.

Also the infeed exit end, particularly the mouthpiece receptacle, is configured as a valve seat for the switching element of the switchover valve, particularly for the control piston of the seat valve. A coolant nozzle of a very small construction size can thus be provided.

A material of the switching element, particularly of the control piston, and a material of the valve seat may be mutually adapted, so that the valve seat has either a lesser or a greater hardness than the switching element, wherein the part having the lesser hardness is annealed. The tightness of the valve and also its service life can be increased on account of a material pairing of this type.

A further preferred refinement, provides a connector block which is screw-fittable to the infeed and which has a first connector for the control air and/or a second connector for the liquid coolant.

The connector block can further have a first conduit, the first connector being connectable to the first inner tube of the infeed while using the first conduit, and/or have a second conduit, the second connector is connectable to the second tube of the infeed while using said second conduit.

By way of such a connector block at the coolant nozzle, the coolant nozzle implements a construction of the coolant nozzle which in terms of construction is simple and flexible because of being modular, having the infeed, the mouthpiece, and the connector block as modules. The individual modules can thus be assembled or disassembled in a simple and rapid manner at any time.

As a result, the coolant nozzle can likewise also be assembled and disassembled in a simple manner. This enables rapid replacement of the coolant nozzle within a plant or a continuous casting plant.

To increase, the cooling output, it is expedient for a plurality of the coolant nozzles to be combined in a superordinate functional unit, in particular in one continuous casting plant.

For example, a cooling installation can be provided for cooling a metallic strand in a continuous casting plant, having a plurality of nozzle units, for example a plurality of spray beams, which in the strand conveying direction are disposed in succession, in particular so as to extend transversely to the strand conveying direction. Each of the nozzle units or each of such spray beams, respectively, in this instance can provide at least one first such coolant nozzle and a second such coolant nozzle as described.

However, each of said nozzle units, or each of such spray beams, respectively, can also preferably provide a plurality, or a multiplicity of such coolant nozzles.

By means of a common control air infeed for specific coolant nozzles, the possibility exists for (specific) coolant nozzles being combined so as to form specific groups, for example, peripheral nozzles for peripheral regions of the strand, or nozzles for a central region in the center of the strand.

In this instance, a pilot control valve for actuating/controlling an entire such nozzle group can sit in such a common control air infeed.

According to one preferred refinement, the first coolant nozzles of the plurality of nozzle units are capable of being supplied with the control air by a first common control air infeed, and/or the second coolant nozzles of the plurality of nozzle units are capable of being supplied with the control air by the second common control air infeed.

It can also be provided that the control air supply in the first common control air infeed is controlled while using a first control valve that is disposed in the first common control air infeed, and/or the control air supply in the second common control air infeed is controlled while using a second control valve that is disposed in the second common control air infeed.

The coolant nozzle, arranged individually and also in a superordinate assembly/circuit, has numerous advantages because the construction of the coolant nozzle has numerous particular advantages.

Because of its design, the coolant nozzle enables the control air and the liquid coolant to be brought very close behind the nozzle exit, up to the mouthpiece, such that the full pressure of the liquid coolant and with an opened switchover valve, bears directly on the coolant nozzle, or a rapid pressure buildup of the liquid coolant in the coolant nozzle is possible, respectively, such that a consistent spray pattern is guaranteed even in the case of low cooling outputs. This occurs with the exception of minor pressure losses in the switchover valve that are however negligible.

For the coolant nozzle, it is also possible for the closed-loop range to be enlarged beyond the closed-group control range of 1:10 or 1:3, respectively, as has usually been possible to date.

Furthermore, the use of "air mist" nozzles can be largely dispensed with such that the cooling of the strand is performed in a substantially more energy efficient manner.

However, the coolant nozzle is not limited to a "water only" nozzle; rather, an "air mist" nozzle can of course also be used.

Furthermore, the constructive design of the coolant nozzle, enables a modular construction mode which enables the simple and/or rapid and/or thus cost-effective replacement of individual components particularly in the event of maintenance or in the event of a change in application/use.

The description of advantageous design embodiments of the invention provided so far includes numerous features which are to some extent reflected so as to be combined with one another. However, those features can expediently also be considered individually and combined to give further expedient combinations. In particular, those features are capable of being combined individually and in any suitable combination with the permanent mold according to the invention and the methods according to the invention. Features of the method worded in substantive terms are thus also to be considered as properties of the corresponding device unit, and vice versa.

Even when some terms in the description, or in the patent claims, respectively, are in each case used in the singular or in conjunction with a numeral, the scope of the invention for said terms is not be limited to the singular or to the respective numeral. Furthermore, the words "a" or "an", respectively, are not be understood as numerals but as indefinite articles.

The properties, features and advantages of the invention described above and the manner in which they are achieved will become more clearly and distinctly comprehensible in conjunction with the following description of the exemplary embodiments of the invention, which are explained in greater detail in conjunction with the drawings. The exemplary embodiments are used to explain the invention and do not restrict the invention to combinations of features, including functional features, that are specified therein. For this purpose, it is furthermore also possible for suitable features of each exemplary embodiment to be considered explicitly in isolation, removed from one exemplary embodiment, introduced into another exemplary embodiment in order to supplement the latter and combined with any one of the claims.

DESCRIPTION OF EMBODIMENTS

Figure 1:
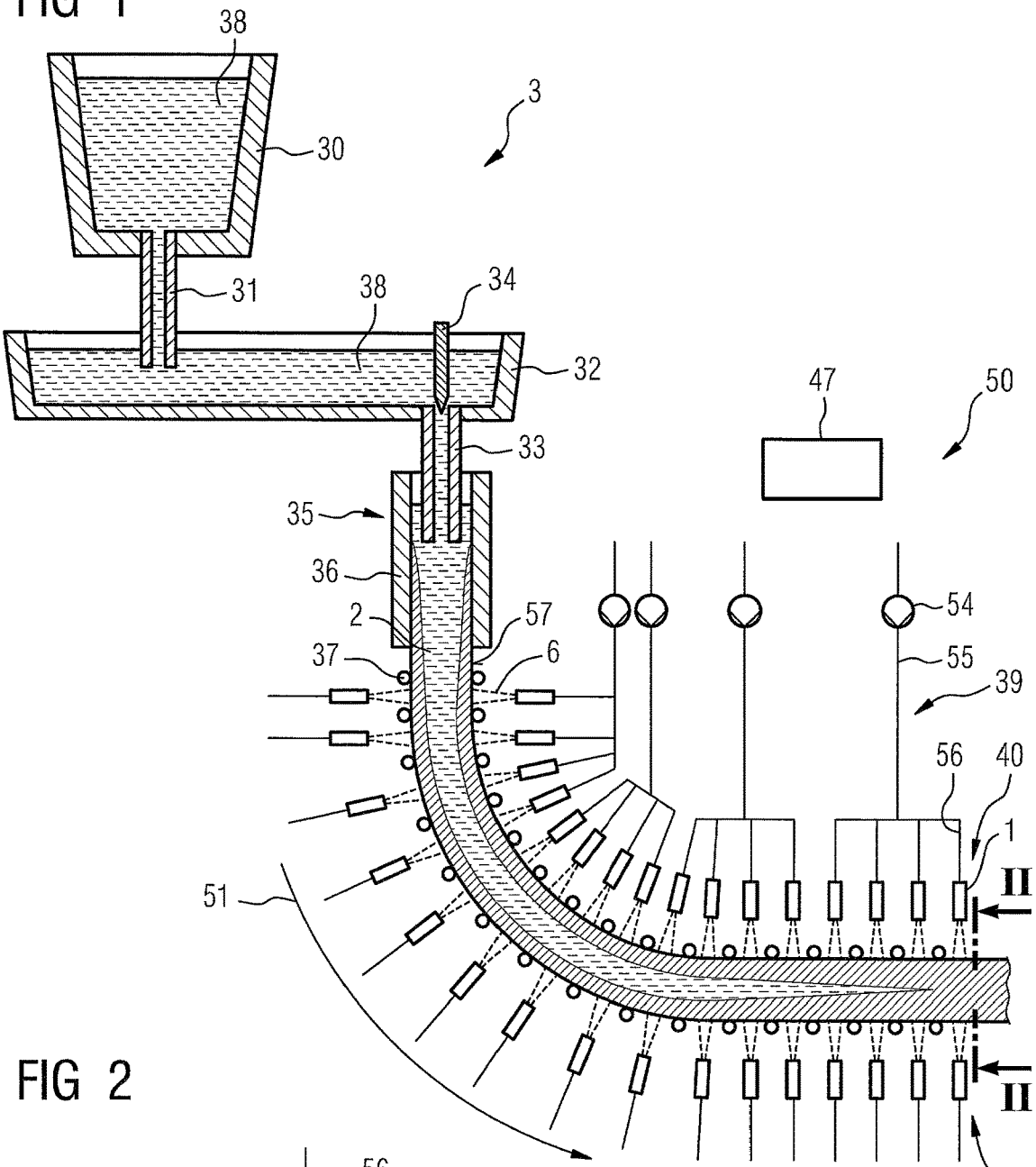
FIG. 1 shows a schematic illustration of a continuous casting plant having a cooling installation.

FIG. 1 shows a continuous casting plant 3 in a schematic illustration. The continuous casting plant 3 can be, for example, a plant for casting steel slabs.

The continuous casting plant 3 comprises inter alia a ladle 30 having an outlet tube 31. The plant 3 further comprises a casting distributor 32 which is disposed below the ladle 30 and which has a casting tube 33 as well as a plug 34 that is disposed in the casting distributor 32.

The continuous casting plant 3 comprises a permanent mold 35 which has four water-cooled permanent plates 36 from copper, and has a rectangular cross-sectional shape. Only two of the four permanent mold plates 36 are visible in FIG. 1.

The plant 3 a moreover comprises a plurality of driven transport rollers 37 which form elements of a strand guide of the continuous casting plant 3.

The plant 3 has a post-connected apparatus, for example, a flame cutting machine, which is not illustrated in the figure.

Liquid steel 38 situated in the ladle 30 is directed into the casting distributor 32 from the outlet tube 31. The liquid steel 38 from the casting distributor 32 is in turn directed into the permanent mold 35 by way of the casting tube 33, so that a mass flow of the steel 38 flowing into the permanent mold 35 is controlled with the aid of the plug 34.

The steel 38 on the contact faces of the water-cooled permanent mold plates 36 cools in the permanent mold 35 and solidifies therein such that the steel 38, then in the form of a strand 2 having a rectangular cross section, exits the permanent mold 35.

When exiting the permanent mold 35, the strand 2 has a solidified shell of several millimeters thickness, while a majority of the cross section of the strand 2 is still liquid. The surface temperature of said strand 2 herein is intended to be at a magnitude of approximately 1000° C.

The strand 2 exiting the permanent mold 35 is transported away from the mold 35 with the aid of the transport rollers 37 and is guided to the post-connected apparatus mentioned earlier (not illustrated in the Figures). By means of the post-connected apparatus, this strand is cut to form slabs, for example, and is subsequently transported away. Alternatively, the strand 2 could be processed directly by another post-connected apparatus, for example a roll stand of a casting/rolling composite plant, without first being divided into slabs.

The continuous casting plant 3 furthermore has a cooling installation 50 for cooling the strand 2.

The cooling installation 50 for cooling the strand 2 from a first side (an upper side in the drawing) comprises a preferred number of sixteen nozzle units 40 that are disposed in succession in the strand conveying direction 51. Another of those 16 nozzle units 40, four nozzle units 40 in succession in the strand conveying direction 51 are each part of a common cooling zone 39 of the cooling installation 50. The sixteen nozzle units 40 are divided into four cooling zones 39 having in each case four nozzle units 40 (See also FIG. 5).

According to FIG. 1, each cooling zone 39 is assigned a dedicated coolant pump 54, a main coolant supply line 55 which is connected to the coolant pump 54 of the cooling zone 39 and from which four individual coolant supply lines 56 branch off. Each coolant supply line 56 is connected to one of the nozzle units 40. However, a single coolant pump, by a main infeed, usually supplies a plurality of cooling zones with coolant. The branching of the coolant, the setting of the pressure or of the throughflow in the individual coolant supply lines 56 of the cooling zones is performed by control valves, for example.

Figure 2:
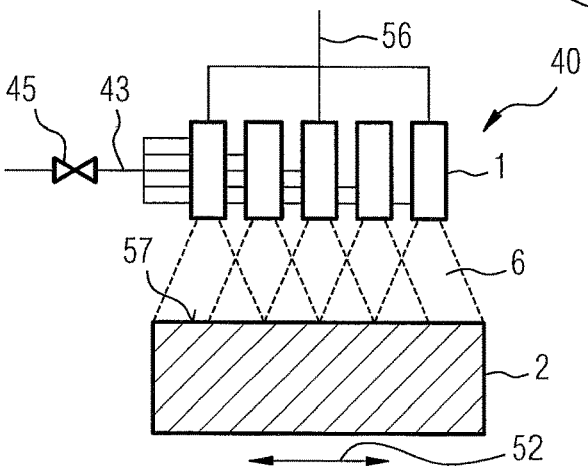
FIG. 2 shows a schematic section through the continuous casting plant from FIG. 1, along the sectional plane II-II therein.

Each of the nozzle units 40 has a row of a plurality of cooling nozzles 1 that in succession, the row extending perpendicular to the strand conveying direction 51, transverse to the strand conveying direction 52 (See FIG. 2).

Figure 3:
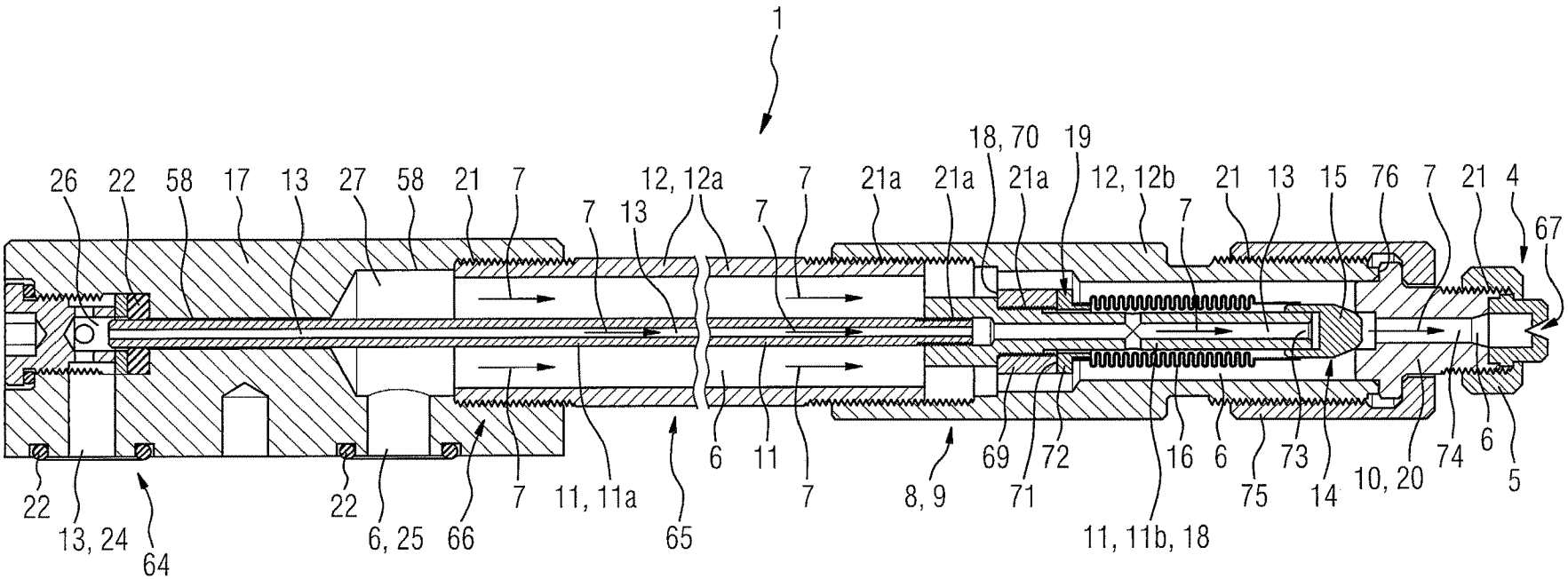
FIG. 3 shows a pneumatically actuatable coolant nozzle for a nozzle unit of a cooling installation of the continuous casting plant from FIG. 1.

Moreover, the coolant nozzles 1 in the present exemplary embodiment have in each case one switchover valve 14 which is integrated in the respective coolant nozzle 1 and is pneumatically controllable by control air 13, presently instrument air (see FIG. 3).

The cooling installation 50 furthermore has a control unit 47, by which the switchover valves 14 are controllable/switchable (see FIG. 5)).

Moreover, the cooling installation 50, for cooling the strand 2 from a second side, the lower side in FIG. 1, opposite the first side, comprises sixteen nozzle units 40 disposed in succession in the strand conveying direction 51. These nozzle units 40 each also have one switchover valve 14 that is pneumatically switchable/activatable by the control unit 47 (See FIG. 3).

Figure 5:
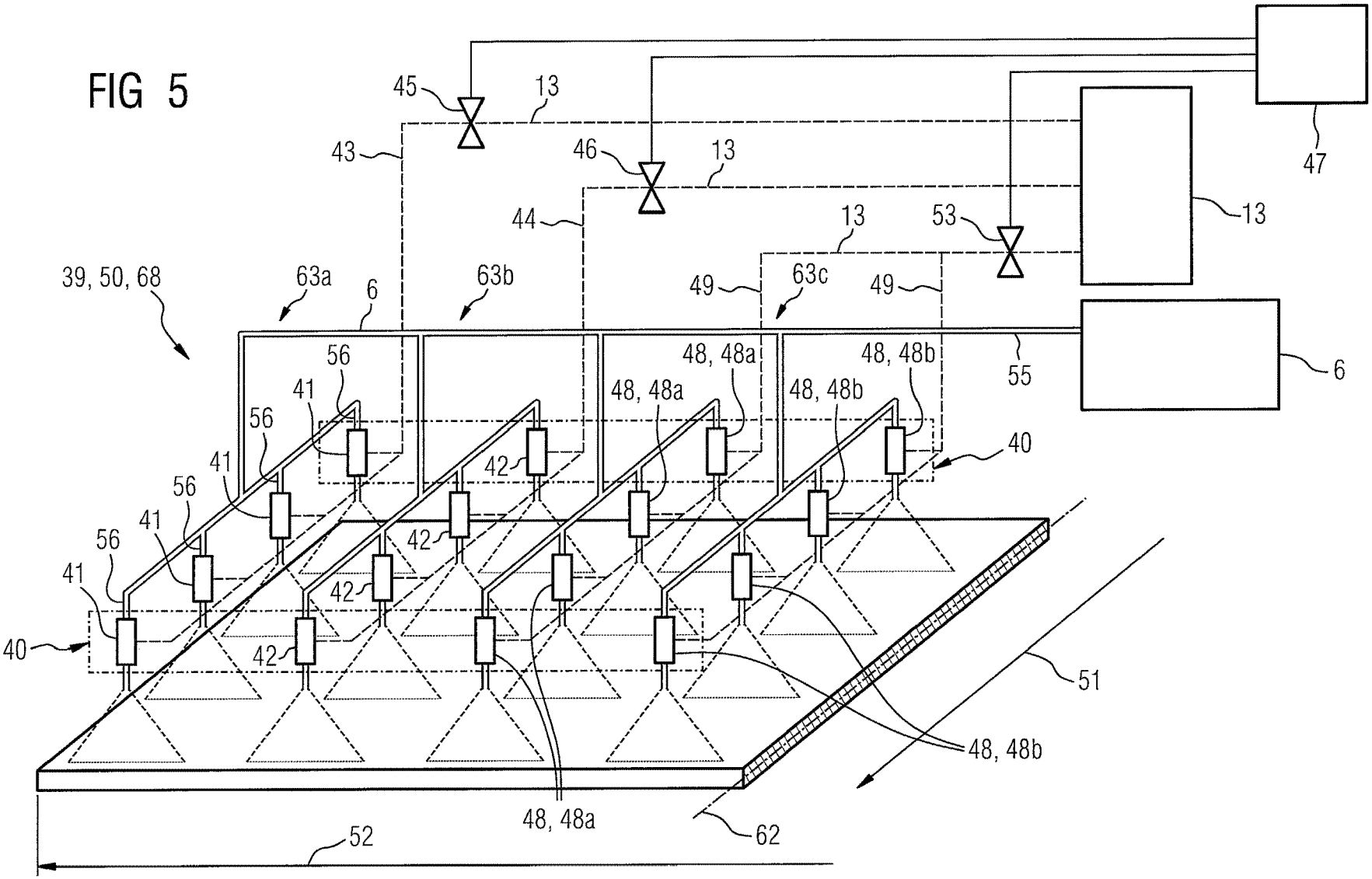
FIG. 5 shows a schematic view of a further cooling installation for a cooling zone for the continuous casting plant from FIG. 1.

Of the last-mentioned sixteen nozzle units 40, four nozzle units 40 in succession in the strand conveying direction 51 are each part of a common cooling zone (See also FIG. 5).

Each of the cooling zones also has a dedicated coolant pump, a main coolant supply line which is connected to the coolant pump of the cooling zone and from which four individual coolant supply lines branch off. These elements are not illustrated in the Figures for improving clarity.

The number of the nozzle units 40 per strand side, in the present case sixteen, and the numerical distribution of said nozzle units 40 among a plurality of cooling zones 39, in the present case four cooling zones 39 per strand side, is chosen as exemplifies. The continuous casting plant 3 could in principle have a different number of nozzle units 40 and/or a different number of cooling zones 39.

Moreover, the cooling installation 50 may comprise a temperature measuring installation (not illustrated), for example a pyrometer, for measuring a surface temperature of the strand 2 in a non-contacting manner. The temperature measuring installation can be connected to the control unit 47 by a data line. A temperature measurement is however not strictly necessary. Alternatively to the temperature measuring installation, the cooling installation 50 may comprise a cooling model (See DYNACS®) which calculates the required water quantities in the cooling zones in real time without measurement of the temperatures.

In principle, the cooling installation 50 can have a plurality of such temperature measuring installations. For example, at least one temperature measuring installation may be provided on the first side of the strand 2 and on the second side of the strand 2.

While the strand 2 is transported away to the post-connected apparatus, the nozzle units 40, and more specifically the coolant nozzles 1, spray a coolant 6 onto the strand surface 57. The strand 2 is cooled in this manner and that increasingly solidifies in the strand conveying direction 51. The coolant 6 in the present case is water.

Each of the nozzle units 40 applies a predefined/adjustable quantity of coolant to the strand surface 57. The quantity is controlled, in terms of quantity and time by the switchover valve 14 of the respective coolant nozzle 1.

The temperature measuring installation measures a surface temperature of the strand 2 and transmits the measured surface temperature to the control unit 47. As a function of the determined surface temperature and of a predefined surface temperature nominal value, by the switchover valves 14, the control unit 47 controls the coolant quantities applied by the coolant nozzles 1 to the strand 2 so that the surface temperature of the strand 2 corresponds to the predefined surface temperature nominal value, or approximates the latter.

The nozzle units 40 on the second side (the lower side in terms of the drawing) of the strand 2, or the coolant nozzles thereon, respectively, are operated in a like manner.

Moreover, a vertical sectional plane II-II which in the end region of the strand guide runs perpendicularly to the strand conveying direction 51 through the continuous casting plant 3 is illustrated in FIG. 1.

FIG. 2 shows a schematic section through the continuous casting plant 3 from FIG. 1, along the sectional plane II-II therein.

The strand 2 and, in an example, one of the nozzle units 40 is illustrated in FIG. 2.

The illustrated nozzle unit 40 has a row of a plurality of, for example, five coolant nozzles 1 that are disposed in succession perpendicularly or transverse to the strand conveying direction 51. The nozzle unit 40 can also be referred to as a spray beam 40), wherein the strand conveying direction 51 in the region of the nozzle unit 40 illustrated is perpendicular to the drawing plane of FIG. 2.

The coolant 6 exits the coolant nozzles 1 in the form of cones or coolant cones. Their form is determinable by way of the mouthpiece 5 of the respective coolant nozzle 1 (See FIG. 3)). In the present case, the coolant cones contact one another on the strand surface 57. It is also possible for the coolant cones to overlap one another.

It can furthermore be seen that the nozzle unit 40 illustrated for the five coolant nozzles 1 thereof, or for the respective pneumatically controllable switchover valve 14 thereof (See FIG. 3), respectively, has a common control air infeed 43, presently instrument air, having a common pilot control valve 45. Application of coolant to the strand surface 57 for the five coolant nozzles 1 in a row is collectively controllable. The coolant 6 herein is fed to the coolant nozzles 1 by the individual coolant supply line 56.

FIG. 3 shows the pneumatically controllable coolant nozzle 1 in detail.

The coolant nozzle 1 has three main components or modules, disposed one behind the other in the throughflow direction 7 including a connector block 17 disposed on the nozzle entry end, an infeed 8 forming the central part 65 of the coolant nozzle 1, and a mouthpiece 5 disposed on the nozzle exit end 4.

Screw-fittings 21 capable of being screw-fitted to one another in pressure-tight manner are capable of easy assembly/disassembly and replacement. Welding-capable connections are suitable as an alternative to screw fittings 21.

The connector block 17 connects the coolant nozzle 1 to the common control air infeed 43, see FIG. 5 for the control air 13 for activating switching the coolant nozzle 1) and to the individual coolant supply line 56 (for the coolant 6 for cooling the strand) (See FIG. 1).

To this end, the connector block 17 comprises a first connector 24 which runs perpendicularly to the throughflow direction 7 of the control air 13 through the coolant nozzle 1. The connector block 17 is connected to the common control air infeed 43 so as to be sealed by a seal 22 comprising an O-ring. The control air 13, thus enters the connector block 17 perpendicular to the throughflow direction 7 by the first connector 24, in the connector block 17, the control air is guided by a first conduit 26 and here is also deflected to the throughflow direction 7, and flows into a first part 11*a* of an inner first tube 11 of the infeed 8. The inner first tube 11 is configured in two parts, the infeed 8 as a tube-in-tube system 9 configured from the two-part inner first tube 11, 11*a*, 11*b*, and a two-part outer second tube 12, 12*a*, 12*b*.

To this end, said first part 11*a* of the inner tube 11 of the infeed 8 is plug-fitted into a bore 58 of the connector block 17. That bore 58 runs in the throughflow direction 7 and is sealed by means of an O-ring 22.

The connector block 17 furthermore provides a second connector 25 which runs perpendicularly to the throughflow direction 7 of the coolant 6 through the coolant nozzle 1 which connects the connector block 17 to the individual coolant supply line 56 so as to be sealed by means of a seal 22, presently likewise an O-ring 22. The coolant 6, thus enters the connector block 17 by way of the second connector 25 perpendicular to the throughflow direction 7. In the connector block 17, the coolant is guided by a second conduit 27 and the coolant is also deflected to the throughflow direction 7, and flows into the first part 12*a* of the outer second tube 12 of the infeed 8 that is configured as a tube-in-tube system 9.

The outer second tube 12 is configured in two parts. To this end, the first part 12*a* of the outer (second) tube 12 of the infeed 8 is plug-fitted into a bore 58 of the connector block 17. That bore 58 runs in the throughflow direction 7, and is screw-fitted by an external thread on the first part 12*a* of the outer (second) tube and an internal thread on the bore 58.

The control air 13 and the coolant 6 can initially enter into the connector block 17 which, on account of the above, is of a very compact construction. The air and coolant are deflected to the throughflow direction 7 in the connector block 17, and can exit the connector block 17 again in the throughflow direction 7, and in a pressure tight manner, they can flow from the infeed 8 into the infeed 8 at the latter by way of the infeed entry end 66 thereof.

The infeed 8 is configured as a concentric tube-in-tube system 9 comprised of the two-parts of an inner first tube 11 having the two part-tubes 11*a* and 11*b*, and the two-part outer tube 12 which has the two part-tubes 12*a*, 12*b* and is disposed concentric with the inner tube 11.

The control air 13 is guided by the inner tube 11, 11*a*, 11*b*, to the switchover valve 14, which is presently shown as a seat valve, that is disposed in the infeed 8 at the infeed exit end 10. The coolant 6 is directed by the outer tube 12, 12*a*, 12*b* into the mouthpiece 5 by the infeed exit end 10 of the infeed 8. The mouthpiece 5 is screw-fitted to the infeed 8 at the infeed exit end 10 of the latter.

Because of the constructive design of the tube-in tube-system 9 at the infeed 8, the coolant nozzle enables the control air 13 and the coolant 6 to be brought to close behind the nozzle exit end 4, or up to the mouthpiece 5.

The spray pattern of the coolant nozzle 1, for example as the coolant cone, can be determined by the design of the mouthpiece exit opening 67.

The two part-tubes 11*a* and 11*b*, and 12*a* and 12*b*, respectively, of the inner tube 11 and the outer tube 12 are in each case screw-fitted to one another in a pressure-tight manner (21). Additionally, the first and the second part-tube 11*a* and 11*b* of the inner tube 11 are also adhesively bonded or welded to one another, respectively.

As is shown in FIG. 3, the switchover valve 14 which is pneumatically activatable/switchable by the control air 13 and which is configured as a seat valve, having a switching element 15 that is configured as a control piston 15 (switchable by the control air 13) sits on the infeed exit end 10. The switchover valve 15 blocking the coolant outflow from the outer tube 12, or from the second part 12*b* of the outer tube 12 of the infeed 8, respectively. The control piston 15 herein by the control air 13 is pushed out of the inner tube 11 into the valve seat 20 of the seat valve 14), or releases the coolant flow.

To this end, the switchover valve/seat valve 14 provides that by means of a (corrugated) bellows 16, preferably from steel, the control piston 15 is guided in the throughflow direction 7, as in the case of a linear guide in an axial/linear manner and sealed in relation to the infeed 8, that is presently the inner tube 11, or the second part 11*b* of the inner tube 11, respectively.

To this end, the corrugated bellows 16, by way of an interference fit sits concentric on the second part 11*b* of the inner tube 11. The second part 11*b* provides a corrugated bellows detent 18 for a sleeve 69 that supports a corrugated bellows support 19 and that supports the corrugated bellows 16.

By way of a front end 70 of the sleeve 69 up to the corrugated bellows detent 18, the sleeve 69 in a pressure-tight manner is screw-fitted and adhesively bonded to the second part 11*b* of the inner tube 11. A shoulder 72 of the (corrugated) bellows support 19 is supported on the rear end 71 of the sleeve 69.

By way of the first end thereof in the throughflow direction 7, the corrugated bellows 16 is placed in a pressure-tight manner onto that end of the corrugated bellows support 19 that is opposite the shoulder 72. By way of the second end in the throughflow direction 7, the corrugated bellows 16 is placed in a pressure tight manner onto the control piston 15, which in the throughflow direction 7 is thus disposed directly ahead of the exit end 73 of the second part 11*b* of the inner tube 11.

When the control air 13 now exits through exit end 73 of the second part 11*b* of the inner tube 11, the control air 13 axially displaces the control piston 15 in the valve seat 20 thereof, whereby the corrugated bellows 16 is stretched. Once there is no longer control air 13 or no control air pressure, respectively, bearing on the control piston 15, the corrugated bellows 16 is again contracted to its original shape, wherein the control piston 15 is again released from the valve seat 20 thereof.

The valve seat 20 is likewise a tubular component forming the infeed exit end 10 of the infeed 8. The seat 20 has a through bore 74 for the coolant 6, and by means of an outer sleeve 75. The seal is braced in a pressure-tight manner in relation to the exit end 76 of the second part 12*b* of the outer tube 12.

As is then furthermore shown in FIG. 3, the mouthpiece 5 is screw-fitted in a pressure-tight manner onto the valve seat 20 and thus also to a mouthpiece receptacle 20.

The material of the control piston 15 and the material of the valve seat 20 are mutually adapted in such a manner that the valve seat 20 has a lesser hardness than the control piston 15.

Figure 4:
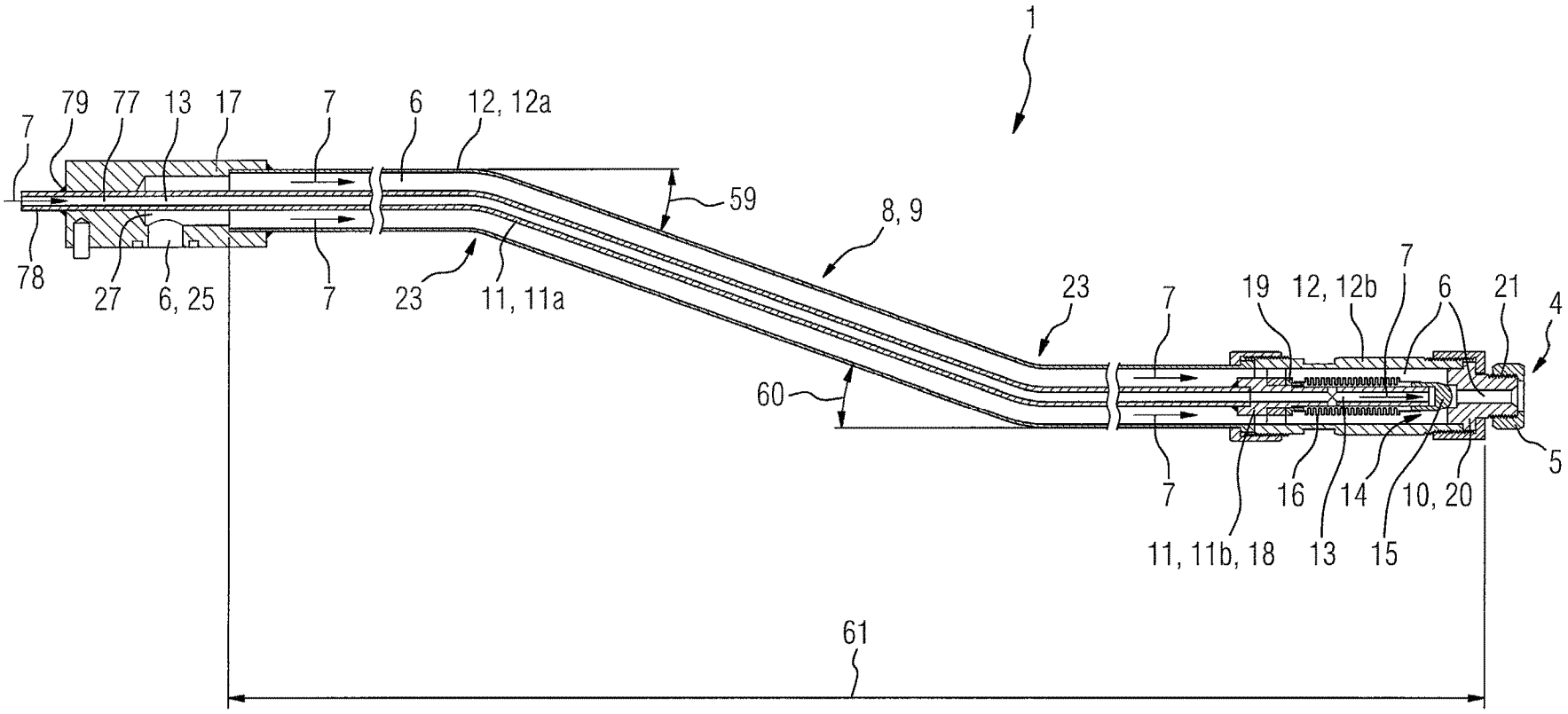
FIG. 4 shows the pneumatically actuatable coolant nozzle for a nozzle unit of a cooling installation of the continuous casting plant from FIG. 1 having a bent infeed.

FIG. 4 shows the pneumatically controllable coolant nozzle 1 in a further embodiment in which the infeed 8 has a double bend 23.

The following description of the coolant nozzle 1 is primarily limited to the points of differentiation in relation to the coolant nozzle 1 described above, and to which reference is made in terms of features and functions that remain the same. See FIG. 3 and associated explanations. Substantially identical or mutually equivalent elements, respectively, are identified by the same reference signs, and features not mentioned are incorporated for the description of said coolant nozzle 1 without said features being described once again.

FIG. 4 shows the infeed bent for a first time in the inflow region of the infeed 8 by a first bending angle of approx. 20° and for a further, second, time in the outflow region by a second bending angle 60 of likewise approx. 20°.

Other first and second bending angles 59, 60, different first and second bending angles 59 and 60, respectively, as well as even more bends having corresponding bending angles, can be implemented in the case of the infeed 8, depending on the specific application.

The most varied coolant nozzle designs can be implemented in a simple and extremely flexible manner the replacement of an infeed 8 is possible entirely without problems by virtue of the screw-fittable modular construction. The coolant nozzle may include dissimilarly designed bending angles 59, 60 on the infeed 8, and/or dissimilar lengths 61 of the infeed 8 per se.

The connector block 17, in FIG. 4, has an axial through bore 77 into which, or through which, the first part 11*a* of the inner tube 11 is push-fitted. The end 78 of the first part 11*a* of the inner tube 11 that protrudes from the connector block 17 is welded to the connector block 17 79.

FIG. 5 schematically shows a cooling installation 50 which in terms of the infeed of the control air 13 is more complex but is of a more flexible design so that different cooling requirements, in particular in terms of the coolant quantity, can be applied to the strand 2, or to the width thereof.

For example, outer or outlying strand regions, in the direction that is transverse to the strand conveying direction 52 thus require less cooling and a lower quantity of coolant than regions on the inside require.

The description of the cooling installation 50 having the coolant nozzles 1 is primarily limited to the point of differentiation in relation to the cooling installation 50 described above (See FIG. 1 and FIG. 2), reference in terms of features and functions that remain the same are also being made. As is expedient, substantially identical or mutually equivalent elements, are identified by the same reference signs, and features not mentioned are incorporated for the description of the cooling installation 50 without being described again.

FIG. 5 shows a cooling zone 39, which is presently illustrated, being the one symmetry aspect 68 of the cooling installation 50 that is symmetrical in relation to the strand centerline 62 comprises a total of four nozzle units 40 or spray beams 40 in the strand conveying direction 51. They have in each case eight coolant nozzles 1 arranged in the direction transverse to the strand conveying direction 52. The cooling installation 50 includes four cooling zones 39 in a manner to be symmetrical in relation to the strand centerline 62. This provides three different control zones 63*a* and 63*b* and 63*c*, all of which are actuatable by the control unit 47.

The outermost left and right in relation to the direction transverse to the strand conveying direction 52, first coolant nozzles 41 of the four spray beams 40 are connected by way of a first common control air infeed 43.

A first pilot control 45 is disposed in the first common control air infeed 43, as shown in FIG. 5, for example, is pneumatically controllable by the control unit 47. The left and right outermost first coolant nozzles 41 of the four spray beams 40 in the cooling zone 39 may be collectively actuated and may be activated independently of the coolant nozzles 1 of the cooling installation 50.

As is likewise highlighted in FIG. 5, each second outermost second coolant nozzles 42 of the four spray beams 40 are correspondingly connected by a (second) common control air infeed 44 having a second pilot control valve 46 disposed thereon and can thus be collectively actuated and activated by the control unit 47.

All further central (third) coolant nozzles 48, or 48*a* and 48*b*, respectively, of the four spray beams 40 are likewise connected by a (third) common control air infeed 49 having a third pilot control valve 53 disposed thereon and can thus be collectively actuated and activated by the control unit 47.

The coolant supply of the coolant nozzles 1, or 41, 42, 48, is by the main coolant supply line 55 and by individual coolant supply lines 56 (cf. FIG. 1 and FIG. 2).

The coolant nozzles 1 are typically disposed directly on a strand guiding segment between strand guiding rollers. It is therefore favorable in terms of the reliability of the control unit 47 and/or of the pilot control valves 45, 46, 53 when the control unit 47 and/or the pilot control valves 45, 46, 53 are disposed on the main body of the continuous casting plant, so as to be away from the strand guide. The control unit 47 and the pilot control valves 45, 46, 53 are thereby not exposed to high temperatures or high air humidity. On the other hand, individual pilot control valves can also be replaced in the ongoing operation of the plant without the continuous casting having to be interrupted for this purpose.

In order for the control air in the event of a segment changeover to be able to be rapidly connected or disconnected, it is advantageous for the control air from the main body having the pilot control valves 45, 46, 53 to be guided to the strand guiding segment by pneumatic quick-release couplings.

While the invention has been illustrated and described in detail by the preferred exemplary embodiments, the invention is not limited by the disclosed examples, and other variations can be derived therefrom without departing from the scope of protection of the invention.

LIST OF REFERENCE SIGNS

1 Coolant nozzle
2 (Metallic) strand
3 Continuous casting plant
4 Nozzle exit end
5 Mouthpiece
6 Coolant
7 Throughflow direction
8 Infeed
9 Tube-in-tube system
10 Infeed exit end
11 First tube, inner tube (for control air)
11*a* First part of the first/inner tube
11*b* Second part of the first/inner tube
12 Second tube, outer tube (for coolant)
12*a* First part of the second/outer tube
12*b* Second part of the second/outer tube
13 Control air
14 Switchover valve, seat valve, valve unit
15 Switching element, control piston
16 (Corrugated) bellows
17 Connector block
18 (Corrugated bellows) detent
19 (Corrugated) bellows support
20 Mouthpiece receptacle, valve seat
21 Screw fitting
21*a* Adhesively bonded screw fitting
22 Seal, O-ring
23 Bend (of (8))
24 First connector
25 Second connector
26 First conduit
27 Second conduit
30 Ladle
31 Outlet tube
32 Casting distributor
33 Casting tube
34 Plug
35 Permanent mold
36 Permanent mold plate
37 Transport roller
38 Steel
39 Cooling zone
40 Nozzle unit, spray beam
41 First coolant nozzle (1)
42 Second coolant nozzle (1)
43 (First) common control air infeed
44 Second common control air infeed
45 (First) (pilot) control valve
46 Second (pilot) control valve
47 Control unit
48, 48*a*, 48*b* further (third) coolant nozzles (1)
49 Third common control air infeed
50 Cooling installation
51 Strand conveying direction
52 Direction transverse to strand conveying direction
53 Third control valve
54 Coolant pump
55 Main coolant supply line
56 Individual coolant supply line
57 Strand surface
58 Bore
59 First bending angle
60 Second bending angle
61 Length
62 Strand centerline
63*a* (First) control zone
63*b* (Second) control zone
63*c* (Third) control zone
64 Nozzle entry end
65 Central part
66 Infeed entry end
67 Mouthpiece exit opening
68 First symmetry aspect
69 Sleeve
70 Front end
71 Rear end
72 Shoulder
73 Exit end
74 Through bore
75 External sleeve
76 Exit end
77 Through bore
78 Protruding end
79 Welded connection

The invention claimed is:

1. A coolant nozzle for cooling a metallic strand in a continuous casting plant, comprising:

a mouthpiece which is disposed on a nozzle exit end and through which liquid coolant from the coolant nozzle can exit;

an infeed configured as a tube-in-tube system comprising;

a first tube which is an inner tube for the control air, and a second tube which is an outer tube, disposed substantially concentric with the inner tube and is for the liquid coolant;

in a throughflow direction, the infeed is disposed ahead of the mouthpiece, and the infeed has an infeed exit end, toward which control air is capable of being guided to the infeed exit end through the first tube of the infeed, the infeed exit end is configured as a mouthpiece receptacle to which the mouthpiece is screw-fittable; and the liquid coolant is capable of being fed in the throughflow direction through the second tube of the infeed and then into the mouthpiece via the infeed exit end;

a switchover valve which is integrated in the infeed, is disposed on the infeed exit end, and is pneumatically activatable while using the control air, the switchover valve having a switching element which is a control piston the infeed exit end is configured as a valve seat for a switching element of the switchover valve, and the switchover valve includes, the control piston of the seat valve; and the switchover valve comprises a seat valve, the switchover valve is configured and operable for controlling the feeding of the liquid coolant into the mouthpiece, and the valve is either opened or closed as a function of the position of the switching element.

2. The coolant nozzle as claimed in claim 1, further comprising at least one of the first tube and/or the second tube is configured of multiple parts.

3. The coolant nozzle as claimed in claim 2, wherein the multiple parts are configured in such a manner that the parts thereof are capable of being screw-fitted or welded to one another.

4. The coolant nozzle as claimed claim 1, further comprising the mouthpiece is configured to be releasably connected to the coolant nozzle.

5. The coolant nozzle as claimed in claim 1, further comprising a material of the switching element including the control piston, and a material of the valve seat are mutually adapted, such that the valve seat has one of a lesser hardness than the switching element, or the valve seat has another greater hardness than the switching element, wherein the part having the lesser hardness is annealed.

6. The coolant nozzle as claimed in claim 1, further comprising a connector block which is screw-fittable to the infeed and which has a first connector for the control air and/or a second connector for the liquid coolant.

7. The coolant nozzle as claimed in claim 6, further comprising the connector block has a first conduit, the first connector being connectable to the first inner tube of the infeed while using the first conduit.

8. The coolant nozzle as claimed in claim 7, further comprising the connector block has a second conduit, wherein the second connector is connectable to the second tube of the infeed while using the second conduit.

9. The coolant nozzle as claimed in claim 1, further comprising the infeed is configured to be rectilinear, or bent, having at least one bend.

10. The coolant nozzle as claimed in claim 9, wherein having at least one bend along a length thereof.

11. The coolant nozzle as claimed in claim 1, further comprising the control air is an instrument air.

12. A coolant nozzle for cooling a metallic strand in a continuous casting plant, comprising:

a mouthpiece which is disposed on a nozzle exit end and through which liquid coolant from the coolant nozzle can exit;

an infeed configured as a tube-in-tube system comprising;

a first tube which is an inner tube for the control air, and a second tube which is an outer tube, disposed substantially concentric with the inner tube and is for the liquid coolant;

in a throughflow direction, the infeed is disposed ahead of the mouthpiece, and the infeed has an infeed exit end, toward which control air is capable of being guided to the infeed exit end through the first tube of the infeed, and the liquid coolant is capable of being fed in the throughflow direction through the second tube of the infeed and then into the mouthpiece via the infeed exit end;

a switchover valve, which is integrated in the infeed, is disposed on the infeed exit end, and is pneumatically activatable while using the control air, the switchover valve having a switching element which is a control piston;

the switchover valve comprises a seat valve, the switchover valve is configured and operable for controlling the feeding of the liquid coolant into the mouthpiece, and the valve is either opened or closed as a function of the position of the switching element and a bellows configured and operable to seal the control piston.

13. The coolant nozzle as claimed in claim 12, further comprising the bellows is disposed concentric with and on the inner tube, and the bellows is disposed on a second part of the inner tube that is configured as a bellows detent and the bellows is configured and operable to be guided axially relative to the inner tube relative to the bellows detent.

14. The coolant nozzle as claimed in claim 6, wherein the bellows is a corrugated bellows.

15. A cooling installation for cooling a metallic strand in a continuous casting plant comprising:

a plurality of nozzle units which are disposed in succession in a strand conveying direction to extend transversely to the strand conveying direction, each of the nozzle units having at least one first coolant nozzle, and at least one second coolant nozzle, wherein the first and second coolant nozzles are as claimed in claim 12; and the first coolant nozzles of the plurality of nozzle units are configured for being supplied with the control air by a first common control air infeed; the second coolant nozzles of the plurality of nozzle units are configured for being supplied with the control air by a second common control air infeed.

16. The cooling installation as claimed in claim 15, further comprising a first control valve for the control air supply in the first common control air infeed that is disposed in the first common control air infeed; and a second control valve for the control air supply in the second common control air infeed that is disposed in the second common control air infeed.

17. A continuous casting plant having a cooling installation as claimed in claim 15.

* * * * *